United States Patent [19]

Devaney, Jr. et al.

[11] Patent Number: 4,965,618

[45] Date of Patent: Oct. 23, 1990

[54] METHOD AND APPARATUS FOR TRANSPORTING AND LIQUID TREATING INDETERMINATE LENGTHS OF WEB MATERIAL

[75] Inventors: Mark J. Devaney, Jr.; Edward H. Wannenwetsch, both of Rochester, N.Y.

[73] Assignee: Eastman Kodak Company, Rochester, N.Y.

[21] Appl. No.: 388,458

[22] Filed: Aug. 2, 1989

[51] Int. Cl.[5] ..... G03D 5/00

[52] U.S. Cl. ..... 354/317; 354/319; 354/324

[58] Field of Search ..... 354/317, 318, 319, 324, 354/325; 134/64 P, 122 P

[56] References Cited

U.S. PATENT DOCUMENTS

| | | | |
|---|---|---|---|
| 2,861,508 | 11/1958 | Baumbach et al. | 354/325 |
| 3,170,382 | 2/1965 | Schwab et al. | 134/122 P |
| 3,277,810 | 10/1966 | Hersh | 134/64 P |
| 3,366,025 | 1/1968 | Layne | 354/324 |
| 3,507,650 | 4/1970 | Land | 354/318 |
| 3,616,742 | 11/1971 | Boyle et al. | 354/319 |
| 3,831,612 | 8/1974 | Limoges | 354/317 |
| 3,968,510 | 7/1976 | Allen | 354/324 |
| 4,003,070 | 1/1977 | Merz et al. | 354/324 |
| 4,025,937 | 5/1977 | Lowry et al. | 354/318 |
| 4,187,022 | 2/1980 | Walter | 354/324 |

*Primary Examiner*—A. A. Mathews

*Attorney, Agent, or Firm*—Charles E. Snee

[57] ABSTRACT

An apparatus for transporting exposed radiation sensitive film strips (102) through process liquids (38) for development includes an essentially vertical, porous serpentine wall (18) formed in oppositely opening loops (32, 34), alternate ones of which partially surround hollow porous partial cylinders (42), thus defining a sinuous path along which a transport web (70) is driven while carrying film strips which are supported treated by process liquids flowing through the porous wall and partial cylinders.

28 Claims, 7 Drawing Sheets

METHOD AND APPARATUS FOR TRANSPORTING AND LIQUID TREATING INDETERMINATE LENGTHS OF WEB MATERIAL

DESCRIPTION

1. Technical Field

This invention concerns methods and apparatus for transporting strips of material of indeterminate length while subjecting such strips to treatment by various process liquids. More particularly, this invention concerns such methods and apparatus which are suited for processing strips of exposed radiation sensitive materials, such as photographic film, by moving such strips over porous surfaces through which a desired process liquid is flowing.

2. Background Art

The processing of radiation sensitive films or papers has been the subject of intense study and research for many decades. Systems and methods have long been used for essentially automatically completing such processing on a rather large scale. More recently, though, much smaller scale, lower volume processors, sometimes referred to as "mini labs," have been developed for so called "one hour" photograph development services and other applications such as graphic arts, medical and dental businesses where economical on site development is desired. Suitable equipment for such smaller scale applications has ranged from hand held canisters in which the user must place film and processing liquid, to fully automated systems into which the user need only insert the exposed film with subsequent processing being completed substantially without manual intervention.

Numerous patents disclose features of such automated processing systems. U.S. Pat. No. 2,861,508 shows a complex processing machine in which a continuous web of sensitized paper is passed over a continuously, preferably horizontally rotating drum while the paper is sprayed with various process liquids at successive stations around the drum. U.S. Pat. No. 3,170,382 shows a photographic processing machine in which a continuous web of film is fed around idler rollers from tank to tank of different processing liquids, while porous rollers are used between tanks to apply still other process liquids. U.S. Pat. No. 3,277,810 discloses a photographic processing system in which a strip of film passes on edge from one tank to the next, with squeegee blades or rollers acting on the film and minimizing carry over between tanks.

Another tank to tank processor is shown by U.S. Pat. No. 3,366,025 and includes a series of driven, pressurized porous rollers in each tank, through which the particular process liquid is pumped into contact with the film being processed. In U.S. Pat. No. 3,616,742, a processing system is shown which includes in each tank a horizontal array of driven, pressurized porous rollers which apply process liquids to the film. Squeegee blades minimize carry over between tanks. U.S. Pat. No. 3,968,510, commonly assigned with the present application, shows a liquid pressurized and stationary porous cylinder along the exterior surface of which a film strip is driven by friction rollers in a helical path while the edges of the film are guided by rails or other devices associated with the cylinder.

Twin rotating vacuum drums are used in the system of U.S. Pat. No. 4,003,070 to hold the film in place while process liquid is circulated about the peripheries of the drums. In U.S. Pat. No. 4,025,937, also commonly assigned with the present application, another helical or spiral path processor is shown which includes a stationary porous cylinder; however, the use of a driven transport web eliminates the need for guide rails or the like for the film. And in U.S. Pat. No. 4,187,022, the film moves in a spiral path over a pressurized porous cylinder under influence of externally driven guide rings.

While processors embodying features of the types shown in these patents have achieved varying degrees of commercial success, the overall cost and complexity of most of such systems appear to have limited their acceptance, particularly by lower budget, lower volume processing services. Because most prior art systems require the use of physically separated tanks for each processing liquid, the film typically must be brought out of each tank, through a set of idler rollers operating in the air and then into the next tank. The dead time between the tanks slows the overall process time since the film is not bathed in process liquid during such times. Furthermore, the brief exposure to air may in some applications have undesirable effects on the process itself. The use of separate tanks also can contribute to the physical size of the apparatus which limits the spaces into which it can be installed properly. And the need for many driven and idler rollers and drums makes many prior art systems complex and difficult to use and maintain.

SUMMARY OF THE INVENTION

The objective of the present invention is to provide an improved process and apparatus for treating elongated webs of material of indeterminate length by transporting the web over a stationary porous surface through which a process liquid is flowing; so that, the process liquid simultaneously supports and treats the web with high agitation.

Another objective of the invention is to provide such an apparatus in which the dead time between process liquids is minimized, thereby improving the speed of the process.

Yet another object of the invention is to provide such an apparatus in which the web is supported during processing substantially always on a layer of liquid flowing over a curved porous surface, thus minimizing straight runs of web which would induce flutter and loss of support of and contact with the web by the process liquid.

A further objective is to provide such an apparatus in which the porous surface is provided on a continuous serpentine wall, thereby providing a larger flow area for process liquids while maintaining a compact, simple structure with few moving parts.

A still further objective of the invention is to provide such an apparatus in which a transport web is used to convey such elongated webs, thereby permitting processing of random lengths and widths of material without the use of leader strips or the like.

These objectives are given only by way of example; thus, other desirable objectives and advantages inherently achieved by the disclosed invention may occur or become apparent to those skilled in the art. Nonetheless, the scope of the invention is to be limited only by the appended claims.

The apparatus and method of the invention are particularly suited for transporting an elongated web, such as strip of exposed photographic film, over a stationary liquid pervious surface through which a process liquid is flowing. A housing is provided which includes an interior processing plenum bounded by the upper, lower and peripheral walls of the housing. This processing plenum may be divided further into additional processing plenums, each having a pair of inlet and outlet plenums, by means of serpentine stationary walls each having a plurality of oppositely opening loops opening alternately into the inlet and outlet plenums. The serpentine wall is made from a porous, liquid pervious material. Hollow cylinders or partial cylinders of the same material are positioned within but spaced radially from those of the loops opening into the outlet plenum, thus defining therebetween an at least partially annular passageway in each outlet plenum. So, when process liquid is pumped into the inlet plenum and the interior of such hollow cylinders, a flow of liquid is established through the liquid pervious material of the hollow cylinders and the serpentine wall into each partially annular passageway in the outlet plenum. An elongated transport web is threaded on edge through the partially annular passageway and along the surface of the adjacent loop opening into the inlet plenum. Thus, when a strip or web of material such as exposed radiation sensitive film is inserted between the transport web and the serpentine wall, the strip is drawn into the apparatus and moves over the surface of the serpentine wall supported on a thin layer of process liquid. Because of the curved surface of the serpentine wall, flutter of the web is reduced, thereby ensuring good support on the layer of process liquid and good treatment by the highly agitated process liquid in such layer. Similarly, as the transport web moves past the hollow cylinders, it is supported on another layer of process liquid. Because the serpentine wall and the hollow cylinders are arranged substantially vertically, the transport web and the process web move through the apparatus on edge and the film of process liquid drains downwardly along the porous surfaces, due to gravity. The transport web and strip of material move directly from one processing plenum to the next with only the interruption of squeegee rollers or other scavenging means t o remove excess process liquid, thus speeding up the processing cycle.

BRIEF DESCRIPTION OF THE DRAWINGS

The presently preferred embodiments of the invention will be described in detail with reference to the accompanying drawings, in which.

DETAILED DESCRIPTION OF THE PREFERRED EMBODIMENTS

Figure 1:
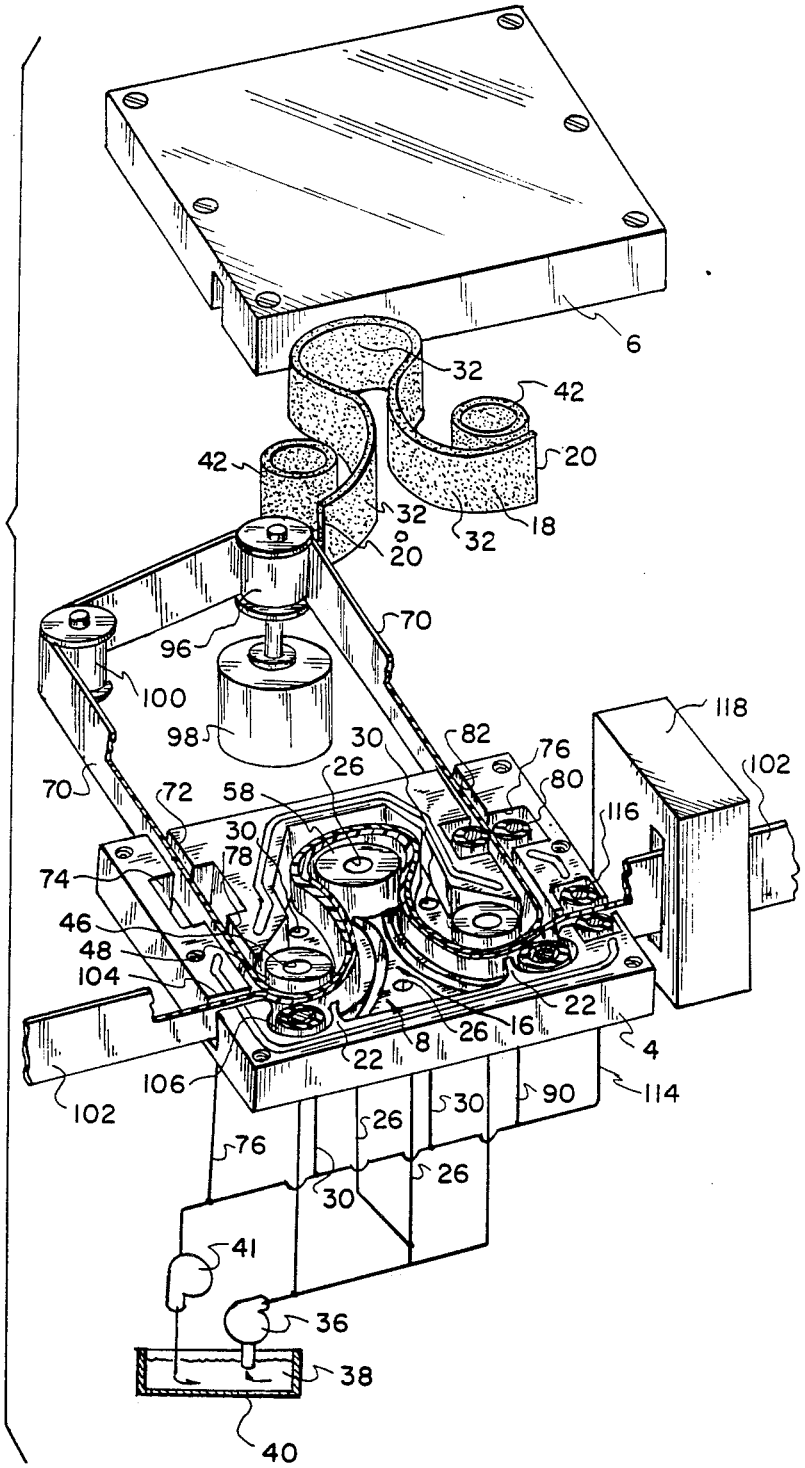
FIG. 1 shows an exploded perspective view of a single cell processing apparatus according to the invention, the transport web, process web and certain rollers being shown in section for ease of illustration.

The following is a detailed description of the preferred embodiments of the invention, reference being made to the drawings in which like reference numerals identify the elements of structure in each of the several Figures.

Referring simultaneously to FIGS. 1, 2A, 2B and 2C, a simplified, single cell embodiment of the invention is illustrated on an expanded scale in which many clearances between and thicknesses of elements have been exaggerated to facilitate illustrating and understanding of the invention. The basic geometry shown, however, may be used in the embodiment of FIGS. 3A, 3B and 3C. The apparatus according to the invention comprises a housing 2 having a bottom portion 4 and a top portion 6 which may be molded from a plastic material such as Udel Number P-1700 polysulfone or other suitable material compatible with the process liquids used in the apparatus. Since the top portion 6 is essentially a mirror image of the bottom portion 4, but without any process liquid inlets or drains, the following discussion will refer mainly to the bottom portion 4, it being clear that those skilled in the art will understand the geometry of the top portion as well.

Figure 2A:
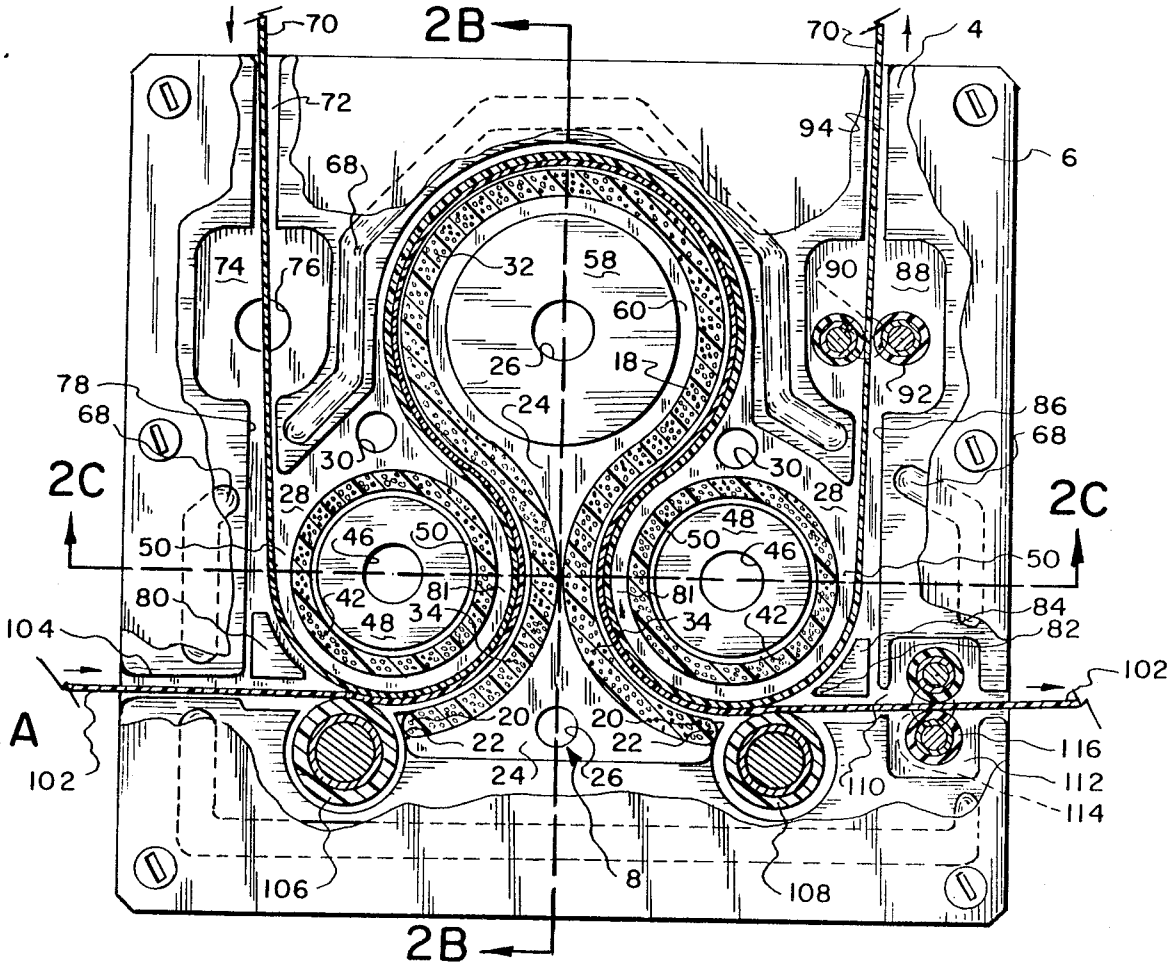
FIG. 2A shows a plan view, partially broken away, of the assembled apparatus of FIG. 1.
Figure 2B:
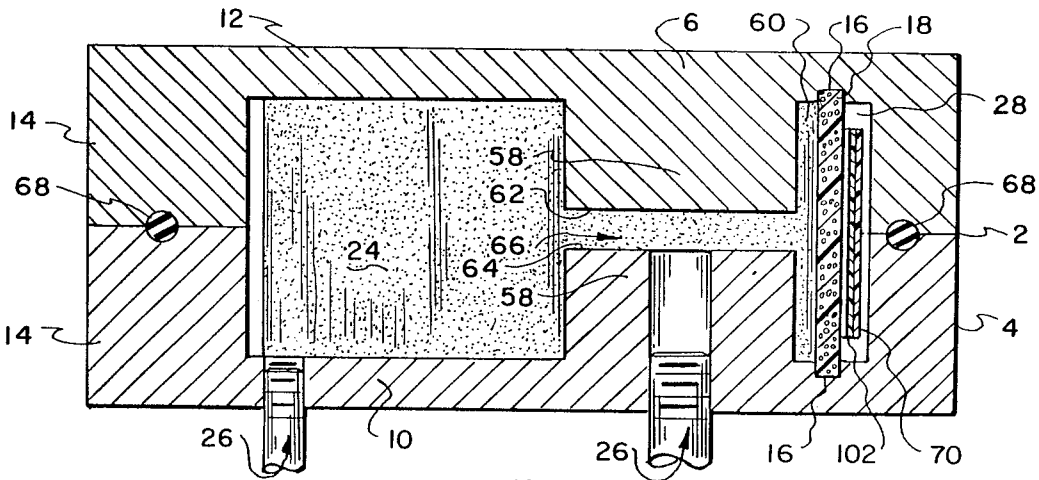
FIGS. 2B and 2C show section views taken along lines 2B—2B and 2C—2C in FIG. 2A.
Figure 2C:
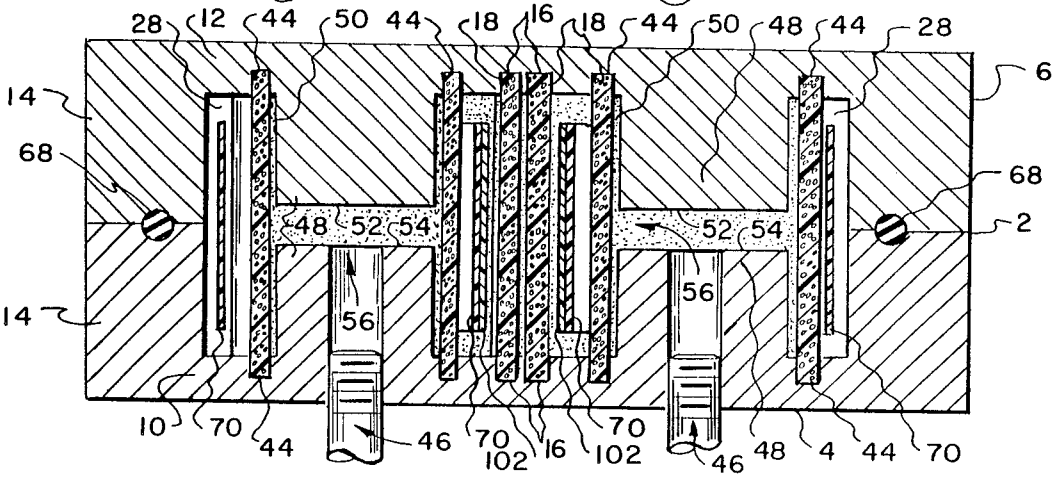

Between bottom portion 4 and top portion 6, an interior plenum 8 is defined which is bounded by a lower wall 10, an upper wall 12 and a peripheral wall 14 as seen most clearly in FIGS. 2A, 2B and 2C. The upper and lower walls include oppositely facing serpentine grooves 16 which snugly receive a stationary serpentine or sinuous wall 18 made from a suitable porous, liquid pervious material such as Porex, a proprietary polyethylene foam available from Porex Technologies of Fairburn, Ga. 30213. In the preferred embodiment of the invention, a 20 to 40 micron porosity is preferred. The extreme ends 20 of serpentine wall 18 are snugly received in vertically extending grooves 22 provided in bottom and top portions 4 and 6. As a result, interior plenum 8 is divided into an inlet plenum 24 having a plurality of process liquid inlets 26 through lower wall 10 and an outlet plenum 28 having a plurality of process liquid drains 30 through wall 10. Serpentine wall 18 is formed so as to define a plurality of oppositely opening loops 32, 34 which open alternately into inlet plenum 24 and outlet plenum 28, respectively. Such loops need not be identical in size or positioned with symmetry or particular balance on each side of the device, so long as the preferred oppositely opening loops are provided.

As illustrated schematically in FIG. 1, a pump 36 is provided to withdraw a process liquid 38 from a suitable sump 40 and pump such process liquid through inlets 26 into inlet plenum 24. At the same time, drains 30 are connected to drain outlet plenum into sump 40. If desired, a further pump 41 may be included in the drain lines to sump 40, to reduce the pressure in outlet plenum 28 to subatmospheric.

A plurality of hollow, at least partially cylindrical bodies 42 are provided which are made of the same porous, liquid pervious material used for serpentine wall 18. These hollow bodies 42 are captured snugly in oppositely facing grooves 44 provided in upper and lower walls 10 and 12, the grooves 44 being positioned to centrally locate bodies 42 within the loops 34 which open into outlet plenum 28. Additional process liquid inlets 46 are provided through lower wall 10 into the interior of bodies 42 and are connected to receive process liquid from pump 36 and deliver that liquid to the interior of bodies 42. Although considerably more moving parts would be required, it is also within the scope of the invention to use freely rotating, liquid pervious rollers in place of bodies 42.

Formed integrally with lower and upper walls 12 are pairs of oppositely extending, at least partially cylindrical bosses or bodies 48 which protrude into the interior of bodies 42 from each end. The diameter of each body 48 is chosen to define a circumferential passageway 50 between the body 48 and each hollow body 42. The bodies 48 comprise oppositely facing end surfaces 52, 54 which are spaced axially from each other to define a radially extending channel 56 which receives process liquid from inlet 46 and conveys it to circumferential passageway 50. The flow through inlet 46 is adjusted during operation so that passageway 50 remains completely full of process liquid.

Similarly, lower and upper walls 10, 12 include integrally formed pairs of oppositely extending at least partially cylindrical bosses or bodies 58 which protrude into the loops 32 which open into inlet plenum 24. The diameter of each cylindrical boss 58 is chosen to define a circumferential passageway 60 between the boss 58 and the adjacent loop 32. The bosses 58 also comprise oppositely facing end surfaces 62, 64 which are spaced axially from each other to define a radially extending channel 66 which receives process liquid from inlet 26 and conveys it to circumferential passageway 60. The flow through inlets 26 is adjusted during operation so that inlet plenum 24 remains completely full of process liquid. A segmented gasket 68 is captured between bottom portion 4 and top portion 6 to minimize leakage of process liquid from inlet and outlet plenums 24 and 28. Any suitable means such as screws may be used to attach top portion 6 and bottom portion 4.

A transport web 70, made from a suitable material such as Mylar, is threaded on edge through outlet plenum 28. Web 70 enters the housing 2 by means of a web inlet passage 72 which opens into a scavenging plenum 74 having a process liquid drain 76 in its lower wall, drain 76 being connected to sump 40 as shown schematically in FIG. 1. From plenum 74, web 70 is led through a further passageway 78 into outlet plenum 28, past a curved guide block 80 and around the exterior surface of cylindrical body 42 through a partially annular passageway 81 defined between cylindrical body 42 and loop 34. Upon leaving passageway 81, web 70 passes around the exterior surface of loop 32 in serpentine wall 18 and then into the passageway 81 defined between the next loop 34 of serpentine wall 18 and the next cylindrical body 42. From there, web 70 moves past the lead edge 82 of a curved separator block 84, then laterally through a passage 86 into an outlet scavenging plenum 88 having a process liquid drain 90 which is connected to sump 40. Within scavenging plenum 88 are mounted a pair of soft squeegee rollers 92 on shafts supported by bottom and top portions 4 and 6, not illustrated in detail. Rollers 92 serve to squeeze from transport web 70 any excess process liquid which has carried over from outlet plenum 28 so that the excess liquid drains back via drain 90 to sump 40. From scavenging plenum 88, the transport web 70 is led through an outlet passage 94, around a drive roller 96 operatively connected to a suitable motor 98, and then on around idler roller 100 and back into inlet passage 72. If desired, a dryer may be included for transport web 70 at some location outside housing 2, in the familiar manner.

A process web or film 102 of indefinite length to be treated by the apparatus may be inserted through a film inlet passage 104 and into a nip defined at cylindrical body 42 between transport web 70 and a preferably undriven pinch roller 106 mounted for rotation between bottom and top portions 4 and 6. Once web 102 has become engaged with transport web 70 at the inlet nip, it is carried by web 70 through passageway 81, around loop 32, then back into the next passageway 81 around the next cylindrical body 42. Depending on the desired residence time in a particular process liquid, the size and number of loops 32, 34 and cylindrical bodies 42 may be increased or decreased for a given speed of web 70. Also, since web 70 and passageway 81 extend around only a portion of each cylindrical body 42, it is within the scope of the invention to provide a porous wall in each body 42 only over that portion of its circumference facing into passageway 81, with a solid wall over the remaining portion of the circumference. Where web 102 is an exposed photographic medium having an emulsion on one side to be treated by liquid 38, then the emulsion side is positioned to face the serpentine wall 18 where it will be bathed and supported out of contact with wall 18 by a highly agitated flow of process liquid coming through porous wall 18.

At the downstream end of serpentine wall 18, web 102 passes a further pinch roller 108 and then passes to the opposite side of guide block 80 from that taken by transport web 70 in the manner previously described. From that point, web 102 is led out of housing 2 through a passage 110 into an outlet scavenging plenum 112 having a process liquid drain 114 connected to sump 40. Within outlet scavenging plenum 112 are a pair of soft squeegee rollers 116 which engage web 102 to remove excess process liquid in a manner similar to the function achieved by squeegee rollers 92. Then, web 102 passes through a dryer 118 before proceeding to a further processing station.

Tests have been completed on prototype components of a processing apparatus of the type shown in FIGS. 1, 2A, 2B and 2C, which would be particularly suited for processing black and white photographic film, in which the thickness of serpentine wall 18 was 0.250 inch; the outside diameter of loop 32 was 3.320 inch; the inside diameter of loop 34 was 2.880 inch; the outside diameter of cylindrical body 42 was 2.750 inch for a transport web 70 having a thickness of 0.012 inch and a web 102 having a thickness of 0.010 inch; the axial height of channel 56 was 1.000 inch; the radial width of circumferential passageway 50 was 0.020 inch; the radial width of annular passageway 81 was 0.105 inch; the axial height of channel 66 was 1.000 inch; and the radial width of circumferential passageway 60 was 0.020 inch. With a system sized in this manner, an inlet pressure of 3.5 psi was sufficient to create the desired flow through serpentine wall 18 and cylindrical bodies 42 to both support and treat a web 102 moving through the apparatus on a transport web 70 moving at a speed of 20 inches per minute. Depending on the particular film being processed, the temperature of the process liquid would be in the range of 65° to 120° F.

In operation of such a device, the inlet plenum 24 is filled by starting pump 36 and venting the interior of housing 2 through suitable vent valves, not illustrated. When a suitable flow of process liquid has been established, movement of transport web 70 is established by motor 98. Then, web 102 may be inserted into the nip between pinch roller 106 and cylindrical body 42. The speed of transport web 70 and the rate of flow through the porous walls are adjusted as necessary to provide the desired support for the process film and the necessary residence time within the device to complete the desired treatment. Additional webs 102 may be fed through the apparatus in close succession.

Figure 3A:
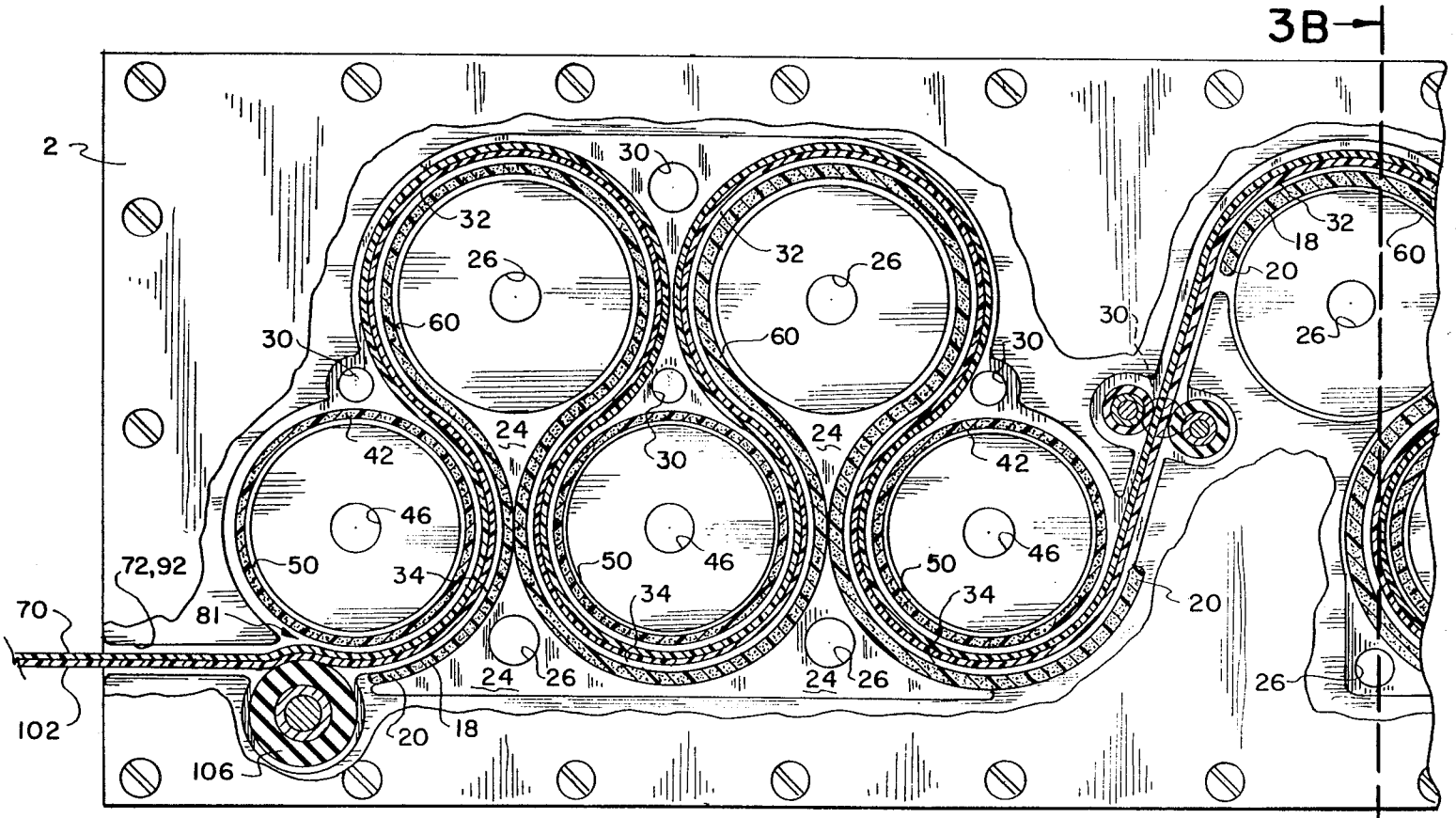
FIGS. 3A, 3B and 3C, when overlapped as indicated, show a plan view, partially broken away to the horizontal center plane of the apparatus, of a four cell apparatus according to the invention.
Figure 3B:
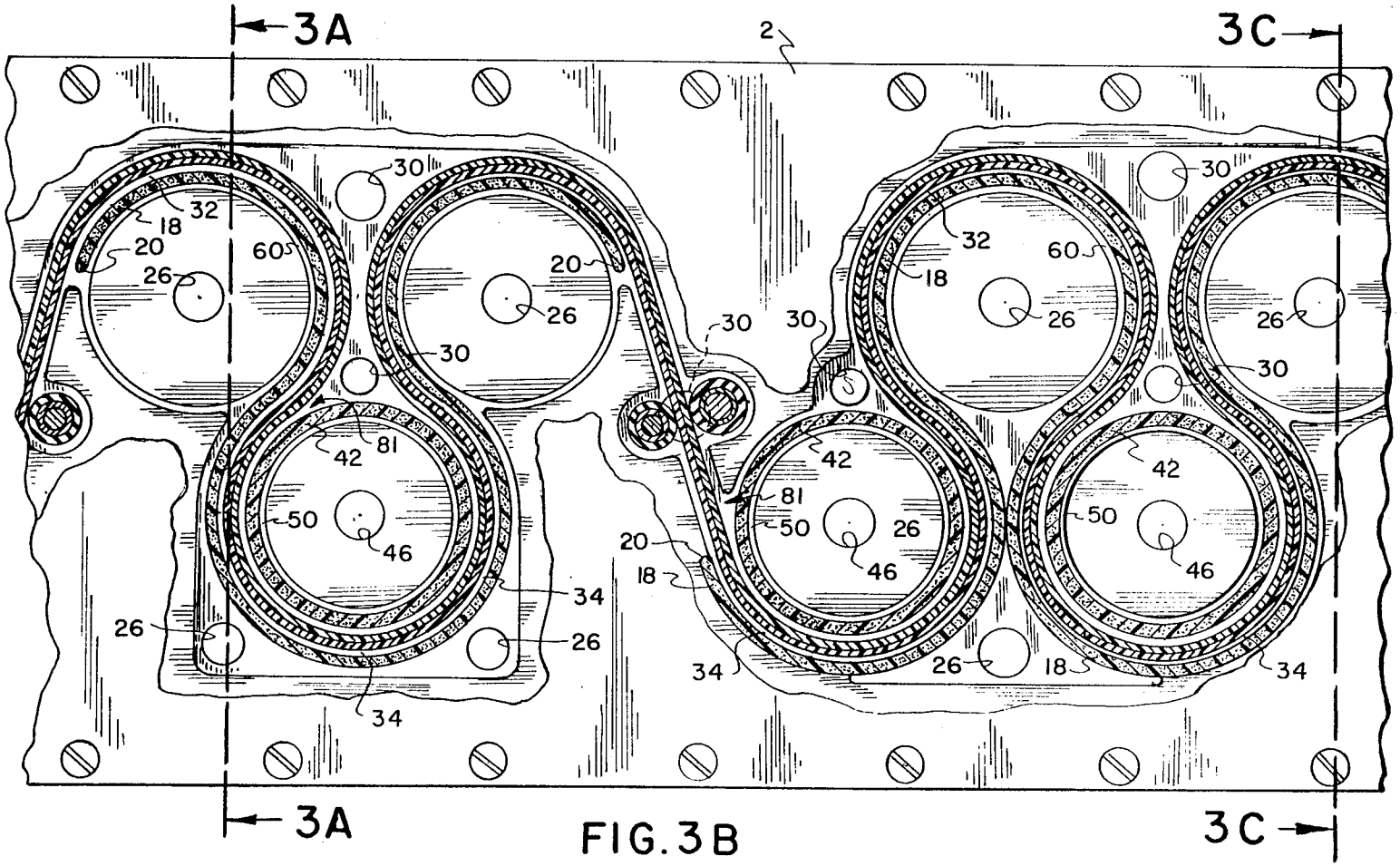
Figure 3C:
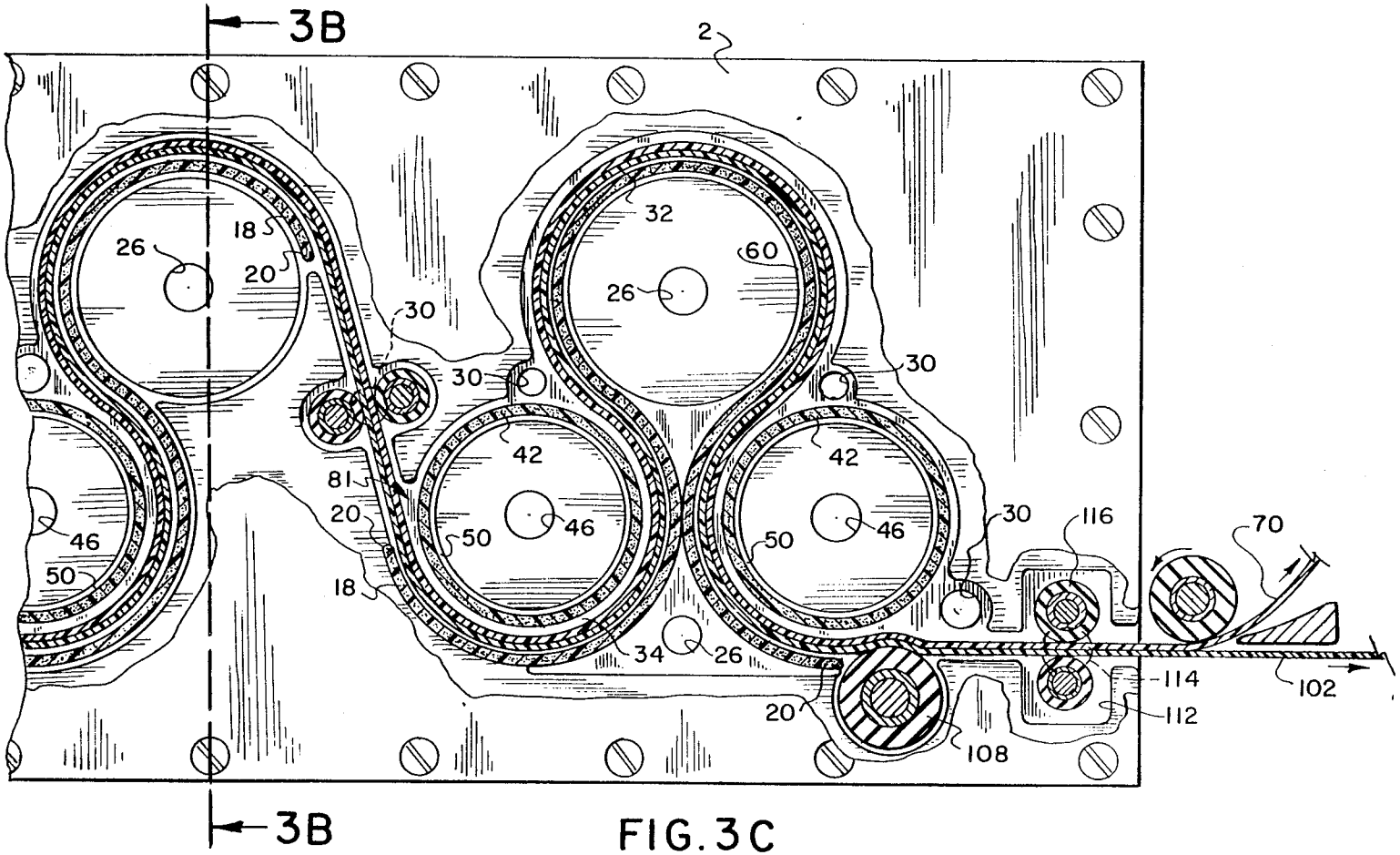

FIGS. 3A, 3B and 3C, taken together, illustrate an embodiment of the invention in which four separate cells of the type shown in FIG. 2A are provided in a single housing with a transport web 70 being used to move web 102 from cell to cell. Between the cells, pairs of squeegee rollers are provided in scavenging plenums to remove process liquid from webs 70 and 102 before they enter the succeeding cell. In such a four cell system, the first cell, as illustrated, might include five separate loops chosen and sized as necessary for the initial development cycle; the second, three separate loops chosen and sized for a bleach cycle; the third, four separate loops chosen and sized for a fixer cycle; and the final, three separate loops chosen and sized for a stabilizer cycle. Those skilled in the art will understand that within each cell and from cell to cell, the individual loops need not be of the same size or the same number but may be adjusted as desired to achieve the necessary treatment within that cell. Similarly, it will be understood that each cell includes its own pump, sump and associated piping, as illustrated in FIG. 1 for a single cell.

Figure 4:
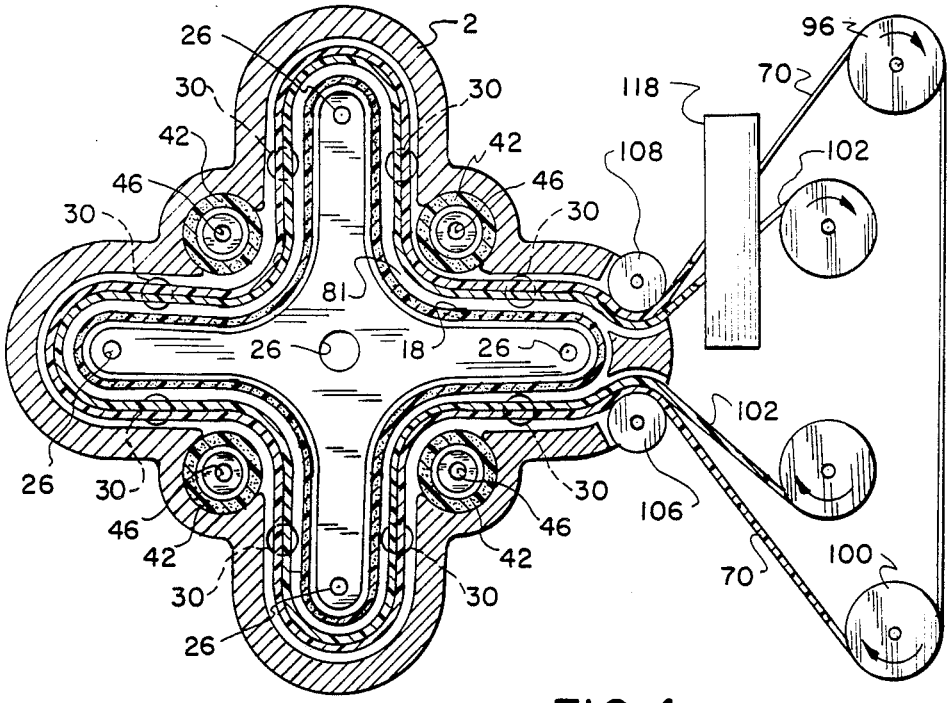
FIG. 4 shows a schematic sectional plan view of an embodiment of the invention in which the serpentine wall forms a closed loop with the transport web running along the outside surface.
Figure 5:
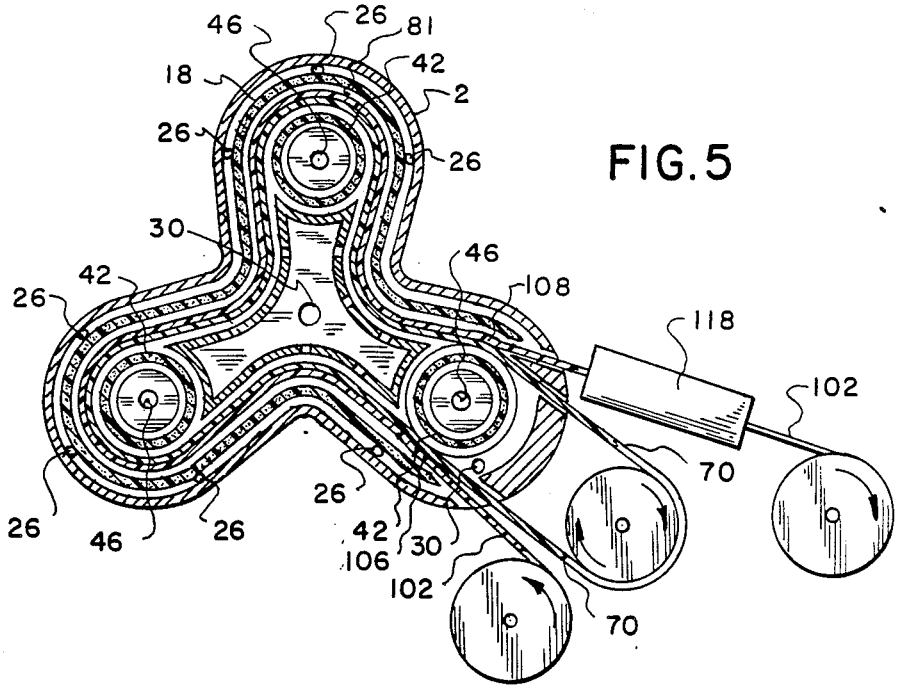
FIG. 5 shows a schematic sectional plan view of another embodiment of the invention in which the serpentine wall forms an essentially closed loop with the transport web running along the inside surface.

FIGS. 4 and 5 illustrate schematically alternative embodiments of the present invention in which serpentine wall 18 has been formed into a closed or substantially closed loop, rather than the open form illustrated in the preceding Figures. For simplicity, the elements of the embodiments shown in these Figures have been assigned the same reference numerals as those previously used. In the embodiment of FIG. 4, serpentine wall 18 has been shaped into a closed form having four inwardly facing loops and four outwardly facing loops. Transport web 70 and web 102 are led over the exterior surface of serpentine wall 18 and, at the outwardly facing loops, between serpentine wall 18 and adjacent cylindrical bodies 42. Of course, any number of inwardly and outwardly facing loops could be used in such a closed form arrangement.

FIG. 5 shows an embodiment of the invention in which serpentine wall 18 has been shaped into a closed form having three inwardly facing loops and three outwardly facing loops with access passages being provided for transport web 70 and web 102 to move along the inner surface of serpentine wall 18 and, at the inwardly facing loops, between serpentine wall 18 and cylindrical bodies 42. Although the drive arrangements for transport web 70 and the feed and take-up reels for web 102 have been illustrated on the exterior of the apparatus, those skilled in the art will appreciate that they can be located within the confines of serpentine wall 18 if desired.

Having described our invention in sufficient detail to enable those skilled in the art to make and use it, we claim:

1. An apparatus for transporting an elongated web over a porous, liquid pervious surface, comprising:

a housing defining an interior plenum having upper and lower walls and a peripheral wall extending therebetween;

at least one serpentine stationary wall means extending substantially vertically between said upper and lower walls for dividing said interior plenum to define liquid inlet and outlet plenums, said serpentine wall means defining a plurality of oppositely opening loops, said loops opening alternately into said liquid inlet and outlet plenums, said serpentine wall means being made from a porous, liquid pervious material between said inlet and outlet plenums;

means for pumping liquid into said inlet plenum to pass through said porous material of said serpentine wall means and into said outlet plenum;

hollow at least partial cylinder means located in those of said loops opening into said outlet plenum, said cylinder means each being made from said liquid pervious material and defining an interior volume connected to receive liquid from said pumping means and to pass said liquid through said material to said outlet plenum, said cylinder means being spaced from said serpentine wall means to define therebetween at least one partially annular passageway in said outlet plenum extending between said upper and lower walls;

means for withdrawing liquid from said outlet plenum;

an elongated transport web threaded on edge through said at least one partially annular passageway and along the surface of the adjacent one of said loops opening into said inlet plenum;

means for permitting insertion, between said transport web and said serpentine wall, of an elongated process web to be transported through said apparatus and treated by said liquid; and means for moving said transport web through said passageway and over said surface, whereby a thin layer of liquid flowing through said serpentine wall means and said cylinder means supports said transport web and said process web in mutual contact but substantially out of contact with the surface of said serpentine wall means and said cylinder means, while said process web is treated by said liquid.

2. An apparatus according to claim 1, wherein said partially annular passageway has a width between said upper and lower wall means exceeding the width of the widest process web to be transported through said apparatus.

3. An apparatus according to claim 1, wherein said peripheral wall means comprises a plurality of openings into said outlet plenum through a first portion of which such transport and process webs enter said housing and through another portion of which they exit.

4. An apparatus according to claim 3, further comprising means adjacent said another portion of said openings for scavenging any of said liquid passing out of said housing through said openings.

5. An apparatus according to claim 1, wherein said process web comprises a radiation sensitive medium and said liquid is a processing solution for forming images carried by said medium.

6. An apparatus according to claim 1, wherein said upper and lower walls comprise pairs of at least partial cylindrical bodies with the members of each pair extending in opposite directions into said interior volumes of said cylinder means, said partial cylindrical bodies being spaced radially inwardly from said cylinder means, thereby defining a passageway for liquid to reach said liquid pervious material; and oppositely opening serpentine grooves for receiving opposite edges of said serpentine wall means.

7. An apparatus according to claim 6, wherein said upper and lower walls comprise further pairs of at least partial cylindrical bodies with the members of each pair extending in opposite directions into those of said loops opening into said inlet plenum, said further at least partial cylindrical bodies being spaced radially inwardly from said loops opening into said inlet plenum, thereby defining a further passageway for said liquid to reach said liquid pervious material.

8. An apparatus according to claim 7, wherein each of said oppositely extending partial cylindrical bodies and further partial cylindrical bodies includes an end face spaced opposite the corresponding end face of the other member of its pair, thereby defining a radially extending channel opening into a respective said passageway; and said means for pumping is connected to said radially extending channel of each said pair.

9. An apparatus according to claim 1, wherein said means for permitting insertion comprises an opening through said peripheral wall at said outlet plenum and near an open end of said at least partially annular passageway, and roller means mounted within said housing to define a nip at said open end between said roller means and said transport web, whereby such process web may be inserted into said nip and drawn into said partially annular passageway by said transport web.

10. An apparatus according to claim 1, wherein said serpentine wall means forms an essentially closed loop with said inlet plenum within said loop and said process web moving around the exterior surface of said loop.

11. An apparatus according to claim 1, wherein said serpentine wall means forms an essentially closed loop with said inlet plenum outside said loop and said transport web and said process web moving around the interior surface of said loop.

12. An apparatus according to claim 1, wherein said outlet plenum is vented to the atmosphere.

13. An apparatus according to claim 1, wherein said means for withdrawing comprises means for pumping fluid out of said outlet plenum to reduce the pressure therein to subatmospheric.

14. An apparatus for transporting an elongated strip of exposed radiation sensitive film through successive baths of processing liquids, said apparatus comprising:

a plurality of processing plenums each having upper and lower walls and a peripheral wall extending therebetween;

at least one serpentine stationary wall means extending in each of said processing plenums between said upper and lower wall means for dividing each said plenum to define liquid inlet and outlet plenums, each said serpentine wall means defining a plurality of oppositely opening loops, said loops opening alternately into said liquid inlet and outlet plenums, said serpentine wall means being made from a porous, liquid pervious material between said liquid inlet and outlet plenums;

means for pumping into said inlet plenum of each successive processing plenum a liquid for partially processing such an exposed film, thereby causing said liquid to pass through said porous material of said serpentine wall means and into said outlet plenum of each successive processing plenum;

hollow, at least partial cylindrical means located in each of said processing plenums in those of said loops opening into said outlet plenum, said cylindrical means being made from said liquid pervious material and defining an interior volume connected to receive liquid from said pumping means and to pass said liquid from said outlet plenum, said cylindrical means being spaced from said serpentine wall means to define therebetween at least one partially annular passageway in said outlet plenum extending between said upper and lower walls;

means for withdrawing liquid from said outlet plenum;

an elongated transport web threaded on edge through said plurality of processing plenums and in each processing plenum through said at least one partially annular passageway and along the surface of the adjacent one of said loops opening into said inlet plenum;

means positioned between successive processing plenums for permitting passage of said transport web from the outlet plenum of one processing plenum to the inlet plenum of the next;

means located at the first of said processing plenums for permitting insertion, between said transport web and said serpentine wall, of an elongated strip of exposed radiation sensitive film to be transported through said apparatus and treated by the processing liquid in each of said processing plenums; and means for moving said transport web and such film through said partially annular passageway and over said surface, whereby in each of said processing plenums a thin layer of liquid flowing through said serpentine wall means and said cylindrical means supports said film and said transport web in mutual contact but substantially out of contact with the surface of said serpentine wall means and said partial cylindrical means while said film is treated by said process liquid.

15. An apparatus according to claim 14, wherein said partially annular passageway has a width between said upper and lower wall means exceeding the width of the widest such film to be transported through said apparatus.

16. An apparatus according to claim 14, wherein said plurality of processing plenums are formed in a single housing with a single peripheral wall, further comprising at least one opening into the outlet plenum of the first processing plenum through which said transport web and such film enter said single housing, and at least one opening from the outlet plenum of the last processing plenum through which said transport web and such film exit said single housing.

17. An apparatus according to claim 16, further comprising means located at said passage means for preventing flow of processing liquid from one processing plenum to the next.

18. An apparatus according to claim 16, wherein said upper and lower walls comprise pairs of at least partial cylindrical bodies with the members of each pair extending in opposite directions into said interior volumes of said cylinder means; and oppositely opening serpentine grooves for receiving opposite edges of said serpentine wall means.

19. An apparatus according to claim 18, wherein said upper and lower walls comprise further pairs of at least partial cylindrical bodies extending in opposite directions into those of said loops opening into said inlet plenum, said further at least partial cylindrical bodies being spaced radially inwardly from said loops opening into said inlet plenum, thereby defining a passageway for said liquid to reach said serpentine wall means.

20. Apparatus according to claim 19, wherein each of said oppositely extending partial cylindrical bodies and further partial cylindrical bodies includes an end face spaced opposite the corresponding end face of the other member of its pair, thereby defining a radially extending channel opening into a respective said passageway; and said means for pumping is connected to said radially extending channel of each said pair.

21. Apparatus according to claim 14, wherein said means for permitting insertion comprises an opening through said peripheral wall of the first of said processing plenums, at said outlet plenum and near an open end of said at least partially annular passageway; and roller means mounted within said first plenum to define a nip at said open end between said roller means and said transport web, whereby such film may be inserted into said nip and drawn into said partially annular passageway by said transport web.

22. An apparatus according to claim 14, wherein for each said processing plenum the number of said loops in said serpentine wall means is chosen to provide the appropriate residence time in each said processing plenum to enable said processing liquid to treat appropriately said film.

23. An improved method for processing elongated strips of radiation sensitive film, comprising the steps of:

providing at least one serpentine wall defining a plurality of oppositely opening loops, said wall extending substantially vertically and being made from a porous, liquid pervious material;

providing in alternate ones of said loops a hollow at least partial cylinder made from said liquid pervious material, said hollow cylinder having an interior volume and being spaced radially inwardly from its associated loop to define therebetween at least one partial annular passageway;

providing an elongated transport web threaded on edge through each said passageway and along the surfaces of the adjacent one of said loops;

moving said transport web through said passageway and along said surface;

inserting between said moving transport web and said serpentine wall said elongated strip of film with the radiation sensitive side of said film facing said serpentine wall; and pumping through said serpentine wall and said partial cylinder into said passageway at least one process liquid used to at least partially process said film, whereby said liquid flowing through said serpentine wall both treats said film and supports it on a layer of liquid substantially out of contact with said serpentine wall and said liquid flowing through said hollow cylinder supports said transport web on a further layer of liquid substantially out of contact with said hollow cylinder.

24. A method according to claim 23, further comprising the step of holding stationary said serpentine wall and said hollow cylinder while said transport web and film are moving.

25. A method according to claim 23, further comprising a final step of repeating the preceding steps using such further process liquids as necessary to completely process said film.

26. A method according to claim 25, further comprising the step of scavenging process liquid from said transport web and film before applying each further process liquid.

27. A method according to claim 23, further comprising the step of forming said serpentine wall into an essentially closed loop.

28. A method according to claim 23, wherein said process web is moved at a constant speed and the number of said loops in said serpentine wall is chosen to provide the appropriate residence time in each further process liquid to enable said processing liquid to treat appropriately said film.

* * * * *